US012741172B2

(12) United States Patent
Leggett

(10) Patent No.: US 12,741,172 B2
(45) Date of Patent: Sep. 22, 2026

(54) EMBO FLO MEDICAL DEVICE

(71) Applicant: Rosalind Leggett, McDonough, GA (US)

(72) Inventor: Rosalind Leggett, McDonough, GA (US)

( * ) Notice: Subject to any disclaimer, the term of this patent is extended or adjusted under 35 U.S.C. 154(b) by 178 days.

(21) Appl. No.: 18/671,911

(22) Filed: May 22, 2024

(65) Prior Publication Data

US 2024/0390726 A1 Nov. 28, 2024

Related U.S. Application Data

(60) Provisional application No. 63/468,438, filed on May 23, 2023.

(51) Int. Cl.

| | |
|---|---|
| ***A63B 21/00*** | (2006.01) |
| ***A63B 21/02*** | (2006.01) |
| ***A63B 21/04*** | (2006.01) |
| ***A63B 22/00*** | (2006.01) |
| ***A63B 23/10*** | (2006.01) |

(52) U.S. Cl.

CPC .... *A63B 21/4034* (2015.10); *A63B 21/00061* (2013.01); *A63B 21/023* (2013.01); *A63B 21/025* (2013.01); *A63B 21/0428* (2013.01); *A63B 21/0442* (2013.01); *A63B 23/10* (2013.01); *A63B 2022/0097* (2013.01); *A63B 2208/0233* (2013.01)

(58) Field of Classification Search

CPC ..... A63B 21/00061; A63B 21/023; A63B 21/025; A63B 21/0428; A63B 21/0442; A63B 21/4034; A63B 23/10; A63B 2022/0097; A63B 2208/0233

See application file for complete search history.

(56) References Cited

U.S. PATENT DOCUMENTS

| | | | | |
|---|---|---|---|---|
| 7,614,978 | B2 * | 11/2009 | Piaget | A63B 21/0085 482/80 |
| 8,029,420 | B1 * | 10/2011 | Thati | A63B 22/0056 482/79 |
| 9,302,153 | B2 * | 4/2016 | Harwin | A63B 21/068 |
| 10,772,783 | B2 * | 9/2020 | Dunca | A63B 21/4034 |
| 11,179,598 | B2 * | 11/2021 | Shoshani | A63B 21/008 |
| 12,194,339 | B1 * | 1/2025 | Alnuaim | A63B 21/4015 |
| 12,251,601 | B2 * | 3/2025 | Gutierrez | A63B 21/4035 |
| 2010/0101973 | A1 * | 4/2010 | Kim | A63B 23/08 482/121 |
| 2018/0318639 | A1 * | 11/2018 | Kim | A63B 22/0046 |

* cited by examiner

*Primary Examiner* — Megan Anderson

(74) *Attorney, Agent, or Firm* — SMITH, GAMBRELL AND RUSSELL, LLP

(57) ABSTRACT

A portable device includes a coil spring and pedal structure that aids travelers on long trips and individuals with impaired muscle tone and/or blood and fluid circulation issues to minimize the possibility of blood clot formation through exercise. The device includes an elongated platform with two wells to receive coiled springs that are secured to both a pedal structure and the platform. The pedals, coiled springs and platform are configured to permit a range of motions so that travelers or impaired individuals can engage in exercise regimens that enhance blood flow by selectively exerting pressure on the pedals that compress the coil spring.

6 Claims, 2 Drawing Sheets

EMBO FLO MEDICAL DEVICE

FIELD OF THE INVENTION

The present invention relates generally to a portable exercise device suitable for use on long trips by travelers and individuals with impaired muscle tone and/or blood and fluid circulation issues.

BACKGROUND OF THE INVENTION

Prolonged sedentary conditions, occurring during trips, can lead to blood pooling. This can lead to clots and conditions such as deep vein thrombosis. The clot can restrict blood flow to the lungs and possibly lead to a pulmonary embolism.

There have been a number of published studies including F. Lurie et al., "Prevention of air-travel related deep venous thrombosis with mechanical devices: Active foot movements produce similar hemodynamic effects", *Journal of Vascular Surgery*, Vol. 44, Issue 4, October 2006, pp 889-91 and C. Collins, et al., "The Tropded, an In-Flight Exercise Device to Prevent Flight Related Deep Vein Thrombosis", ICRAT Proceedings, Bulgaria, Summer 2006.

Typical prior art devices that exemplify the general and specific treatments and devices include those shown in published applications: US2001/102371398, US2002/0160892, IN1270/KOL/2007, WO2020/133029, US 2019/0076696, US 2010/0101973, US 2004/0121888, US 2014/0231221, and U.S. Pat. Nos. 2,2851,166, 6,679,817 and 7,975,941.

However, there still remains a need for a device that is portable, simple in design and easy to use on long trips.

SUMMARY OF THE INVENTION

The present invention is a portable compact device that helps with blood flow management while traveling with a resistance based exercise pedal system. The device includes an elongated platform including two wells into which the lower end of the coil spring is placed and secured. The upper end of the coiled spring is affixed to the lower surface of a pedal. The platform and spring structure cooperate to position the spring so that the spring can be compressed by motions of the entire foot on the pedal or the sole motion on the toe region or heal region of the pedal by the subject's foot. This range of motions produce the exercise of muscle groups that contribute to blood flow management. The length of the spring and the application and relaxation of force over the entirety of the pedal simulates walking. The diameter of the coil spring and the pedal dimensions create a fulcrum-like structure that results in the separation of the motions caused by application of force solely on the toe or heal portions of pedal by the subject's foot. Spring resistivity can also be varied to provide the desired degree of resistance for an exercise. The selection of resistivity can also reflect an average value appropriate for a range of exercise activities. The duration of an exercise activity ensures an exercise target appropriate for blood flow management is met.

The length and width of the platform maintains platform stability placement during use. The stability of the position of the platform can be enhanced by including a surface on the bottom of the platform to increase friction between the floor and the platform. That frictional surface can be localized, e.g., at the platform ends. The platform can include a telescoping structure that permits adjustment of the length of the platform or the spacing between the wells so that the position of the pedals is appropriate for the traveler.

Suitable regimens include calf raises, toe raises and fast feet. Calf raises include pressing the front of the pedals from the plane position downward and return. Toe raises include pressing the heal region of the pedal from the plane position downward and return. Fast feet include moving both feet to cause the pedal to move downward from the plane and return to its original position. The regimens affect the calve muscles, which are the main venous pump of blood.

Typically, the performance of each regimen involves placing the device on the floor directly in front of the seated traveler. The platform is secured by material on both ends made from a component similar to rubber that has resistance traction against floor for stability. The pedals are swiveled from a position aligned with the central axis of the elongated platform to a frontal position where the pedals are perpendicular to that axis. The seated traveler can then engage with the device by placing their feet on the pedals and performing the regimen,

BRIEF DESCRIPTION OF THE DRAWINGS

The preferred embodiments of the invention are described in conjunction with the appended figures. The figures are provided to illustrate but not limit the invention.

DETAILED DESCRIPTION OF THE INVENTION

The following description is exemplary in nature and is not intended to limit the described embodiments or the application and uses of the described embodiments.

Device

The device is lightweight, travel size platform structure, typically made of metal or other appropriate material, e.g., aircraft grade aluminum shaft (possibly alloy). Typically, the platform base has a length of 12-15 inches that includes an optional structural element that permits adjustment of the length.

Figure 1:
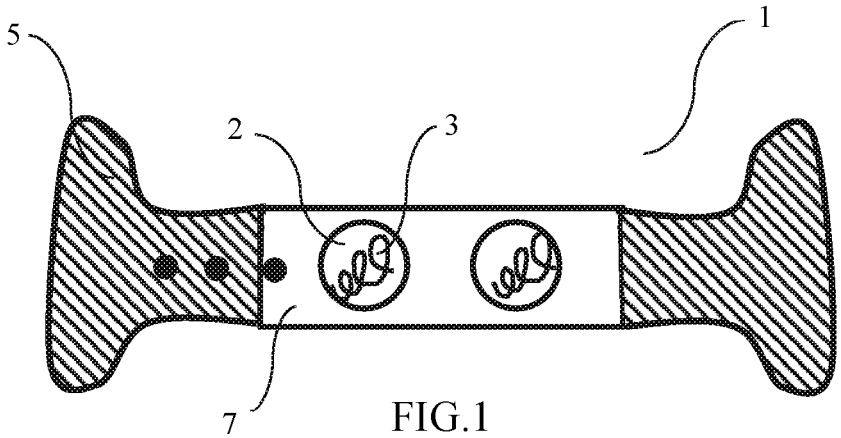
FIG. 1 shows an overview of the device showing the two wells containing coil springs where the pedal is not attached.
Figure 2:
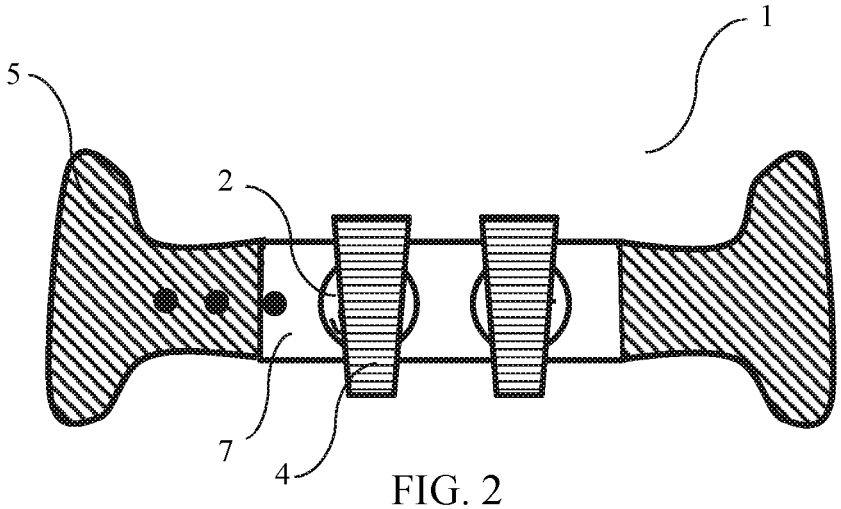
FIG. 2 shows an overview of the device where the pedals are attached to the coil springs and are positioned perpendicular to the central axis.
Figure 3:
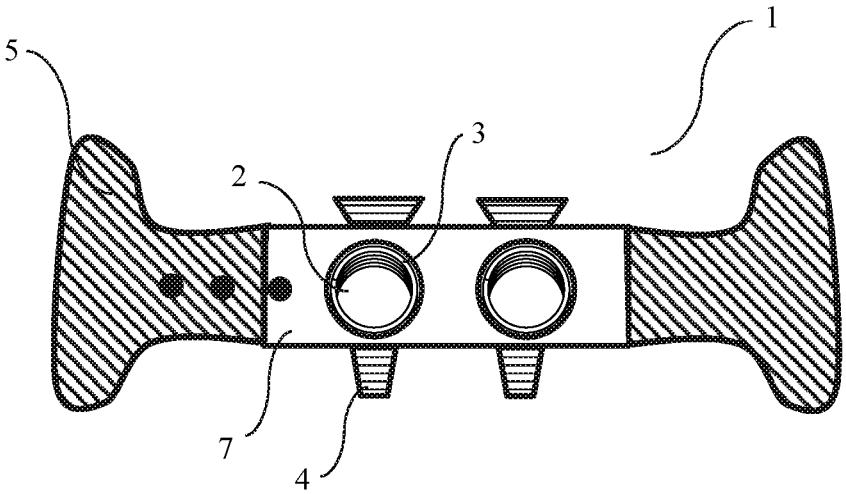
FIG. 3 shows a view of the bottom of the device showing the attachment of the well spring with securing screws and the rubberized surface areas (shaded) at each of the ends of the platform, which stabilize the platform when in use.

The device (1) as shown in FIGS. 1-3 includes an elongated platform (7) having a central axis (9) and two wells (2) situated along that axis. A coiled spring (3) is secured within the well (2) by friction or mechanical means, e.g., screw, clamp, etc. The coil spring (3) may be of any suitable material, e.g., Titanium SPRINGS/coil so long as it has sufficient resistivity to promote exercise. The coil spring (3) has sufficient length (h) to extend beyond the well, permit attachment to the pedal (4) and movement of the pedal (4) so that a desired range of exercise motions are possible, e.g. up and down motion due to pressure localized either on the toe or heel regions of the pedal (CALF RAISES, TOE RAISES) and pressure on the entire pedal to mimic running or walking (FAST FEET regimen). The upper portion of the coil spring is physically attached to the lower portion of the pedal by a fastener or placed within a well, a cup-like structure, formed on the lower surface of the pedal to secure the spring within the cup-like structure by friction. The forms of attachment employed for physically attaching either the upper or lower portions of the coil spring within the platform well or to the lower pedal surface are conventional means for that purpose. The lower pedal surface may include a cup-like structure for receiving the upper portion of the coil spring. This structure permits motion and positioning of the pedal so that it can be aligned with or be perpendicular to the central axis of the platform. This degree of motion permits the pedal to be properly aligned for transport and for exercise use.

Figure 4:
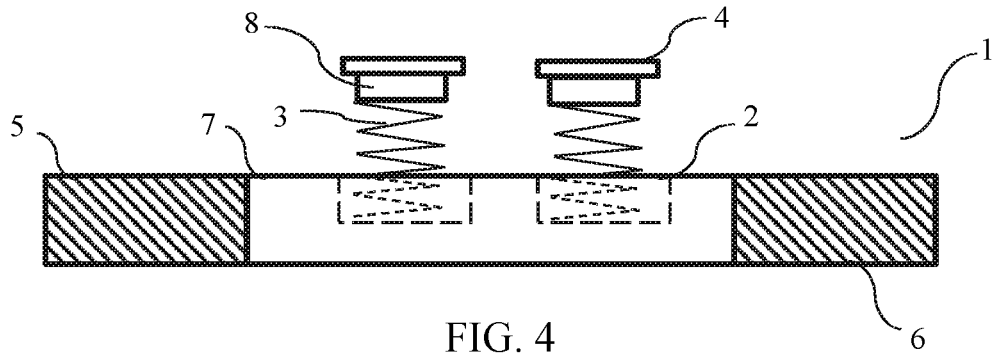
FIG. 4 shows a side view of the device. A coil spring is shown as extending from each of the wells into the cup structure located on the bottom surface of each pedal. The end portion (toe or heal portion) of the pedal is shown. The length of the pedal extends perpendicular to the central (lateral) axis of the platform.
Figure 5:
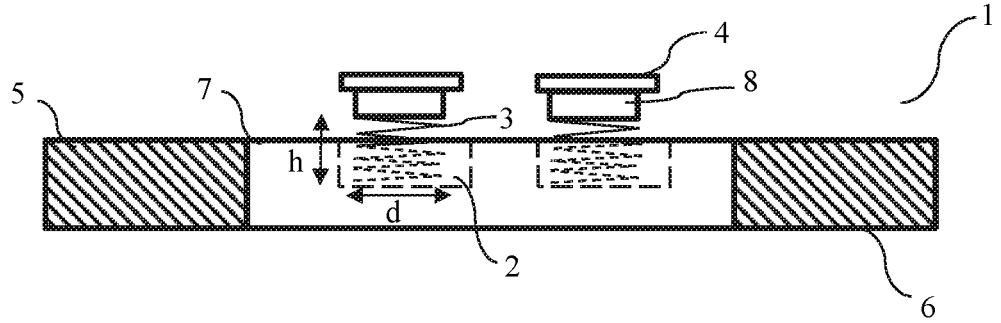
FIG. 5 shows a side view similar to FIG. 4 but shows the spring when compressed. The length of the compressed spring is represented by "h" and the diameter of the coil is indicated by "d". (The length of the spring that extends into the cup structure is not shown.)

Shown in FIGS. 4-5 is a side view of device platform that shows the placement of the coil spring (3) within the platform well (2) and pedal cup structure (8). The coil spring (3) is compressed in FIG. 5 and expanded in FIG. 4. The toe and heal regions of the pedal define the length of the pedal (4). The width of the pedal accommodates the device user's foot. The size of the pedal provides the user with adequate support for the exercise regimens.

Additionally, FIG. 5 references the length (h) of the compressed coil spring (3) and the diameter (d). (The length of the spring that extends into the cup structure (8) is not shown.) The length of the spring can vary but is sufficient to permit the performance of the exercise regimen. The diameter of the spring influences the range of pedal motion possibilities since it functions as a fulcrum due to its position on the lower pedal surface. A wider diameter affects the fulcrum function and the performance of certain exercises. In addition, the diameter of the spring can be of a sufficient dimension to result in a friction fit friction fitting within the platform well (2). The degree 0f friction holds the coil spring in the well during exercise.

Figure 6:
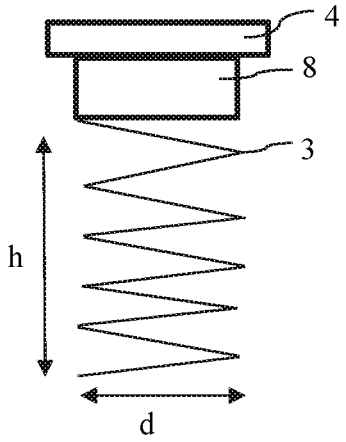
FIG. 6 shows a view of the pedal separated from the platform with the coil spring extending from the cup structure. The length of the extended spring is represented by "h" and the diameter of the coil is indicated by "d". (The length of the spring that extends into the cup structure is not shown.)

Shown in FIG. 6 is an end view of the pedal from either the toe or heal ends where the pedal (4) is not connected with the platform. The coil spring (3) is shown extending from the cup structure. The coil spring length (h) and diameter (d) are referenced. (The length of the spring that extends into the cup structure is not shown.) The diameter of the spring can be of a sufficient length to permit a friction fit friction fitting within the pedal cup structure. The friction suffices to hold the coil spring in place during exercise.

Operation

The device permits a seated traveler to exercise and maintain blood flow, which should avoid clotting. The device is positioned in front of the seated traveler so that traveler can engage with the pedals when the pedals are perpendicular to the platform central axis. The pedals are moved in a manner to perform any of calf raises, toe raises, fast feet alone or as a series of exercises. The motions required for each are as follows: calf raises include pressing the front of the pedals from the plane position downward and return, toe raises include pressing the heal region of the pedal from the plane position downward and return and fast feet includes moving both feet to cause the pedal to move downward from the plane and return to the original position. The duration of each regimen can vary. The guidelines relative to exercise duration are available from recognized sources, e.g. CDC, NIH.

Although the invention herein has been described with reference to particular embodiments, it is to be understood that these embodiments are merely illustrative of the principals and applications of the present invention. Accordingly, while the invention has been described with reference to the structures and processes disclosed, it is not confined to the details set forth, but is intended to cover such modifications or changes as may fall within the scope of the following claims.

DRAWING ELEMENTS

Device (1)
Well (2)
Coil spring (3)
Pedal (4)
Handle portion (5)
Rubberized surface (6)
Platform (7)
Pedal cup structure (8)
Central axis (9)

What is claimed is:

1. A device comprising an elongated platform with a central axis present in a plane and two ends, two wells located in close proximity to each other along the central axis, coil springs having an upper and lower end and each pedal of the two pedals having a top and bottom surface and a toe and heal portion, where each pedal is positioned in a plane parallel to the plane of the elongated platform, where the lower end of each of the coil springs is positioned within a respective well of the two wells and the upper end is affixed to the bottom surface so that the respective pedal is configured to pivot above and below the parallel plane containing the two pedals and where the lower end of the coil spring within the wells is movable permitting the two pedals to align with the platform central axis or be perpendicular to the platform central axis.

2. The device of claim 1, where each of the two ends of the platform include a handle structure having a top and a bottom and where the bottom comprises a surface imparting friction.

3. The device of claim 1, wherein the elongated platform further comprises a structure to permit elongation or retraction and fixing the position in the retracted or elongated position.

4. The device of claim 1, where the top surface of the two pedals includes friction material.

5. The device of claim 1, where the coil spring have sufficient tension to provide resistance and exercise levels appropriate to improve blood flow.

6. An exercise method comprising, positioning the device of claim 1 so that it is in front of a seated traveler and the two pedals are perpendicular to the central axis and positioned to permit contact with the feet of the seated traveler, and moving the two pedals in a manner to perform a regimen selected from any one of calf raises, toe raises, fast feet and combination thereof, where calf raises include pressing the front of the two pedals from the plane position downward and return, where toe raises include pressing the heal region of the two pedals from the plane position downward and return and where the fast feet include moving both feet to cause the two pedals to move downward from the plane and return.

* * * * *